US011788230B2

(12) United States Patent
Miyazawa et al.

(10) Patent No.: US 11,788,230 B2
(45) Date of Patent: Oct. 17, 2023

(54) PAPER PRODUCING APPARATUS

(71) Applicant: SEIKO EPSON CORPORATION, Tokyo (JP)

(72) Inventors: Kazuma Miyazawa, Nagano (JP); Naoya Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 17/485,660

(22) Filed: Sep. 27, 2021

(65) Prior Publication Data

US 2022/0098794 A1 Mar. 31, 2022

(30) Foreign Application Priority Data

Sep. 29, 2020 (JP) ..... 2020-163400

(51) Int. Cl.
*D21F 7/06* (2006.01)
*D21G 9/00* (2006.01)
*D21F 1/02* (2006.01)

(52) U.S. Cl.
CPC ..... *D21F 7/06* (2013.01); *D21F 1/02* (2013.01); *D21G 9/0027* (2013.01)

(58) Field of Classification Search
CPC ... D21F 9/00; D21F 11/02; D21F 7/06; D21F 1/02; D21F 1/024; D21G 9/0009; D21G 9/0027
See application file for complete search history.

(56) References Cited

U.S. PATENT DOCUMENTS

2020/0131705 A1* 4/2020 Higuchi ..... D04H 1/736

FOREIGN PATENT DOCUMENTS

JP H08-013376 A 1/1996
WO 2018/173849 A1 9/2018

* cited by examiner

*Primary Examiner* — Eric Hug
(74) *Attorney, Agent, or Firm* — Global IP Counselors, LLP

(57) ABSTRACT

A paper producing apparatus includes: a sieve portion having a plurality of openings; a web forming portion having a deposition surface on which a material passing through the openings and containing fibers is deposited, the web forming portion forming a web on the deposition surface; a sheet forming portion that processes the web into a sheet; and a material supply pipe through which transport airflow containing the material is supplied to an inside of the sieve portion.

4 Claims, 9 Drawing Sheets

PAPER PRODUCING APPARATUS

The present application is based on, and claims priority from JP Application Serial Number 2020-163400, filed Sep. 29, 2020, the disclosure of which is hereby incorporated by reference herein in its entirety.

BACKGROUND

1. Technical Field

The present disclosure relates to a paper producing apparatus.

2. Related Art

JP-A-8-13376 discloses a technique in which, in the process of producing paper, the thickness of paper is controlled such that the deviation is small. More specifically, in an apparatus disclosed therein, in a papermaking process in which base paper obtained by separating a solid from white water containing a pulp component is pressed, dried, and wound, the grammage is controlled such that the deviation from a preset thickness of paper is small, based on the thickness of paper measured before the paper is wound.

The apparatus disclosed in JP-A-8-13376 has a valve that controls the amount of the pulp component by controlling the amount of white water containing the pulp component to be supplied. However, when the pulp component forms agglomerates, it is difficult to stably control the amount of the pulp component at an intended value. This leads to a problem in that the thickness of the paper to be produced is nonuniform.

SUMMARY

According to an aspect of the present disclosure, there is provided a paper producing apparatus including: a sieve portion having a plurality of openings; a web forming portion having a deposition surface on which a material passing through the openings and containing fibers is deposited, the web forming portion forming a web on the deposition surface; a sheet forming portion that processes the web into a sheet; and a material supply pipe through which transport airflow containing the material is supplied to an inside of the sieve portion. The material supply pipe includes a first supply pipe, a branch portion at which the first supply pipe is split, a second supply pipe that couples the branch portion and one end of the sieve portion in a rotation axis direction, a third supply pipe that couples the branch portion and the other end of the sieve portion in the rotation axis direction, and an axis driver that shifts an axis of one of the first supply pipe and the branch portion with respect to an axis of the other.

DESCRIPTION OF EXEMPLARY EMBODIMENTS

A paper producing apparatus of the present disclosure will be described in detail below based on the embodiments illustrated in the attached drawings.

1. First Embodiment

Figure 1:
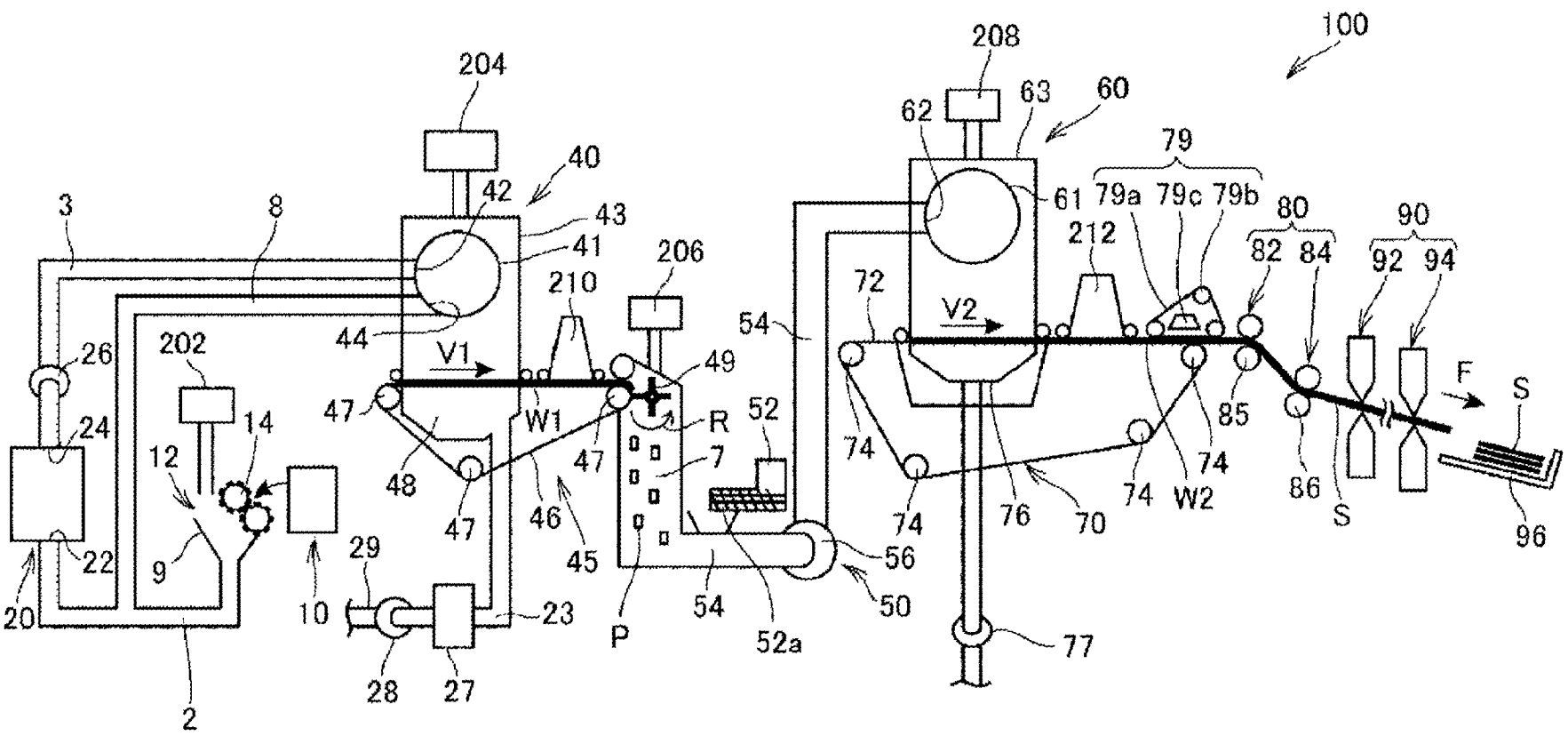
FIG. 1 schematically shows the structure of a paper producing apparatus according to a first embodiment.

FIG. 1 schematically shows the structure of a paper producing apparatus 100 according to a first embodiment.

The paper producing apparatus 100 is suitable for producing new paper through a process including, for example, defibrating used wastepaper, serving as a raw material, in a dry environment, pressing, heating, and cutting. Various additives may be mixed with the fiberized raw material to improve the bond strength or the whiteness of the paper product, or to add functions, such as color, scent, and flame resistance, according to the purpose. Furthermore, by controlling the density, thickness, and shape of the paper, paper of various thicknesses and sizes, such as standard-sized (e.g., A4, A3, etc.) office paper and business card paper, can be produced according to the purpose.

The paper producing apparatus 100 includes a supply portion 10, a coarse crushing portion 12, a defibration portion 20, a classifying portion 40, a first web forming portion 45, a rotary member 49, a mixing portion 50, a deposition portion 60, a second web forming portion 70, a transport portion 79, a sheet forming portion 80, and a cutting portion 90.

The paper producing apparatus 100 also includes humidifying portions 202, 204, 206, 208, 210, and 212 for moisturizing at least one of the raw material and the space in which the raw material moves. The humidifying portions 202, 204, 206, 208, 210, and 212 may be of any type, such as a steam type, a vaporization type, a hot-air vaporization type, or an ultrasonic type.

In this embodiment, the humidifying portions 202, 204, 206, and 208 are vaporization or hot-air vaporization humidifiers. More specifically, the humidifying portions 202, 204, 206, and 208 have filters (not shown) saturated with water and supply humidifying air in which the humidity is increased by allowing air to pass through the filters. The humidifying portions 202, 204, 206, and 208 may also have heaters (not shown) for effectively increasing the humidity of the humidifying air.

In this embodiment, the humidifying portions 210 and 212 are ultrasonic humidifiers. More specifically, the humidifying portions 210 and 212 have vibrating portions (not shown) that transform water into mist, and supply the mist generated by the vibrating portions.

The supply portion 10 supplies a raw material to the coarse crushing portion 12. The raw material from which the paper producing apparatus 100 produces sheets contains fibers, and examples thereof include paper, pulp, pulp sheets, and cloth or woven fabric including nonwoven fabric. In this embodiment, an example case in which the paper producing apparatus 100 uses wastepaper as a raw material will be described. The supply portion 10 may have, for example, a stacker in which sheets of wastepaper are stacked, and an automatic feeder that feeds the wastepaper from the stacker to the coarse crushing portion 12.

The coarse crushing portion 12 cuts (coarsely crushes) the raw material, supplied by the supply portion 10, into coarsely crushed pieces with a pair of coarse crushing blades 14. The coarse crushing blades 14 cut the raw material in a gas, such as air. The coarse crushing portion 12 includes, for example, the coarse crushing blades 14, which nip and cut the raw material, and a driver, which rotates the coarse crushing blades 14, and has a structure similar to the structure of a so-called shredder. The coarsely crushed pieces may have any shape and size, as long as the pieces are suitable for defibration processing in the defibration portion 20. For example, the coarse crushing portion 12 cuts the raw material into paper pieces of one to several centimeters square or paper pieces smaller than that.

The coarse crushing portion 12 has a chute 9, which is a hopper that receives the coarsely crushed pieces cut by and falling from the coarse crushing blades 14. The chute 9 has, for example, a tapered shape in which the width gradually decreases in the direction in which the coarsely crushed pieces flow. Hence, the chute 9 can receive a large number of coarsely crushed pieces. A pipe 2 communicating with the defibration portion 20 is joined to the chute 9. The pipe 2 forms a transport path through which the raw material (coarsely crushed pieces) cut by the coarse crushing blades 14 is transported to the defibration portion 20. The coarsely crushed pieces are collected by the chute 9 and are transferred (transported) to the defibration portion 20 through the pipe 2.

The humidifying portion 202 supplies humidifying air to the chute 9 of the coarse crushing portion 12 or to the vicinity thereof. This structure prevents the coarsely crushed objects cut by the coarse crushing blades 14 from being electrostatically attracted to the inner surfaces of the chute 9 and the pipe 2. Furthermore, because the coarsely crushed objects cut by the coarse crushing blades 14 are transferred to the defibration portion 20 with the humidifying air, an effect of suppressing attachment of defibrated objects to the inside of the defibration portion 20 is expected. The humidifying portion 202 may be configured to supply humidifying air to the coarse crushing blades 14 to eliminate static on the raw material supplied by the supply portion 10. Furthermore, an ionizer may be used with the humidifying portion 202 to eliminate static.

The defibration portion 20 defibrates the coarsely crushed objects cut by the coarse crushing portion 12. More specifically, the defibration portion 20 defibrates the raw material (coarsely crushed pieces) cut by the coarse crushing portion 12 to produce defibrated objects. Herein, the term "defibrate" means to disentangle a raw material (material to be defibrated) that is made of multiple fibers bound together into single fibers. The defibration portion 20 also separates the substances attached to the raw material, such as resin particles, ink, toner, and antibleeding agents, from the fibers.

The objects obtained by passing through the defibration portion 20 are called "defibrated objects". Besides the disentangled defibrated fibers, the "defibrated objects" may contain additives such as: resin separated from the fibers when the fibers are disentangled, that is, resin particles for binding multiple fibers; coloring agents, such as ink and toner; antibleeding agents; and a paper reinforcing agent. The disentangled defibrated objects are in a string shape or a ribbon shape. The disentangled defibrated objects may be either in a state of not being entangled with other disentangled fibers, that is, in an independent state, or in a state being entangled with other disentangled defibrated objects to form agglomerates, that is, in a state of having "lumps".

The defibration portion 20 defibrates the raw material with a dry method. Herein, the term "dry method" means to perform processing, such as defibration, not in a liquid, but in a gas, such as atmosphere (air). In this embodiment, the defibration portion 20 uses an impeller mill. More specifically, the defibration portion 20 includes a rotor (not shown) that rotates at a high speed, and a liner (not shown) located on the outer circumference of the rotor. The coarsely crushed pieces of the raw material, cut by the coarse crushing portion 12, are pressed between the rotor and the liner of the defibration portion 20 and defibrated. The defibration portion 20 generates airflow by the rotation of the rotor. With this airflow, the defibration portion 20 can suck the coarsely crushed pieces, serving as the raw material, from the pipe 2 and transport the defibrated objects to the discharge port 24. The defibrated objects are discharged from the discharge port 24 into the pipe 3 and are transferred to the classifying portion 40 through the pipe 3.

As described, the defibrated objects produced by the defibration portion 20 are transported from the defibration portion 20 to the classifying portion 40 by the airflow generated by the defibration portion 20. Furthermore, in this embodiment, the paper producing apparatus 100 includes a defibration portion blower 26, which is an airflow generating device. The defibrated objects are transported to the classifying portion 40 by the airflow generated by the defibration portion blower 26. The defibration portion blower 26 is attached to the pipe 3. The defibration portion blower 26 sucks the air in the defibration portion 20, together with the defibrated objects, and blows the air to the classifying portion 40.

The classifying portion 40 has an introduction port 42 through which the defibrated objects defibrated by the defibration portion 20 flow in through the pipe 3, together with the airflow. The classifying portion 40 classifies the defibrated objects introduced from the introduction port 42 according to the length of the fibers. More specifically, the classifying portion 40 classifies the defibrated objects defibrated by the defibration portion 20 into first classified objects, which are defibrated objects smaller than or equal to a predetermined size, and second classified objects, which are defibrated objects larger than the first classified objects. The first classified objects include fibers or particles, and the second classified objects include, for example, large fibers, undefibrated pieces (coarsely crushed pieces that are not fully defibrated), and lumps in which defibrated fibers are agglomerated or entangled.

In this embodiment, the classifying portion 40 includes a drum 41 and a housing 43 accommodating the drum 41.

The drum 41 is a cylindrical member that is rotationally driven by a motor and includes mesh, such as a filter or a screen. By using the pores in the mesh, the drum 41 classifies the defibrated objects into the first classified objects, which are smaller than the pores (openings) in the mesh, and the second classified objects, which are larger than the pores in the mesh. The mesh of the drum 41 may be, for example, wire mesh, expanded metal formed by stretching slitted sheet metal, or perforated metal formed by providing holes in sheet metal with a press machine or the like.

The defibrated objects are introduced into the drum 41 from the introduction port 42, together with the airflow. The first classified objects fall down through the pores in the mesh of the drum 41 as the drum 41 rotates, whereas the second classified objects, which cannot pass through the pores in the mesh of the drum 41, are guided to the discharge port 44 and then to the pipe 8 by the airflow entering the drum 41 from the introduction port 42.

The pipe 8 couples the inside of the drum 41 and the pipe 2. The second classified objects flowing through the pipe 8 flow through the pipe 2 together with the coarsely crushed pieces cut by the coarse crushing portion 12 and are guided to the introduction port 22 in the defibration portion 20. In this way, the second classified objects are returned to the defibration portion 20 for defibration processing.

The first classified objects to be classified by the drum 41 pass through the pores in the mesh of the drum 41, are dispersed in the air, and fall down on a mesh belt 46 of the first web forming portion 45 located below the drum 41.

The first web forming portion 45 (separation portion) includes the mesh belt 46 (separation belt), three rollers 47, and a suction portion 48 (suction mechanism). The mesh belt 46 is an endless belt stretched over the three rollers 47 and is driven in the direction indicated by arrow V1 by the action of the rollers 47. The surface of the mesh belt 46 is formed of mesh having openings of a predetermined size. Among the first classified objects falling from the classifying portion 40, fine particles that can pass through the pores in the mesh fall down through the mesh belt 46, and fibers that cannot pass through the pores in the mesh are deposited on the mesh belt 46 and are transported in the direction of arrow V1 by the mesh belt 46. The fine particles falling down through the mesh belt 46 include relatively small or low-density defibrated objects, resin particles, coloring agents, additives, or the like, and these particles are elimination objects that will not be used by the paper producing apparatus 100 to produce sheets S.

The mesh belt 46 runs at a predetermined speed during a normal operation for producing sheets S. This speed is, for example, a certain speed that is set in advance.

Herein, "during a normal operation" means a duration in which an operation except for the startup control and the stopping control (described below) of the paper producing apparatus 100 is performed and, more specifically, a duration in which the paper producing apparatus 100 is producing sheets S of a desired quality.

The defibrated objects obtained through the defibration processing in the defibration portion 20 are classified into the first classified objects and the second classified objects in the classifying portion 40, and the second classified objects are returned to the defibration portion 20. Furthermore, the elimination objects are removed from the first classified objects by the first web forming portion 45. The objects remaining after the removal of the elimination objects from the first classified objects are the material suitable for producing sheets S. This material is deposited on the mesh belt 46 to form a first web W1.

The suction portion 48 sucks the air from below the mesh belt 46. The suction portion 48 is coupled to a dust collector 27 (a dust collecting device) by a pipe 23. The dust collector 27 separates fine particles from the airflow. A collecting blower 28 is provided downstream of the dust collector 27. The collecting blower 28 serves as a dust-collecting suction portion, which sucks the air in the dust collector 27. The air discharged from the collecting blower 28 is discharged to the outside of the paper producing apparatus 100 through a pipe 29.

With this structure, the collecting blower 28 sucks the air in the suction portion 48 through the dust collector 27. In the suction portion 48, fine particles that can pass through the pores in the mesh belt 46 are sucked with the air and are guided to the dust collector 27 through the pipe 23. The dust collector 27 separates the fine particles that have passed through the mesh belt 46 from the airflow and accumulates the fine particles.

As a result, the fibers remaining after the removal of the elimination objects from the first classified objects are deposited on the mesh belt 46, forming the first web W1. The suction with the collecting blower 28 facilitates the formation of the first web W1 on the mesh belt 46 and accelerates the removal of the elimination objects.

The humidifying portion 204 supplies humidifying air to the space including the drum 41. This humidifying air moisturizes the first classified objects in the classifying portion 40. This structure reduces attachment of the first classified objects to the mesh belt 46 due to electrostatic force, making it easy to separate the first classified objects from the mesh belt 46. This also reduces attachment of the first classified objects to the inner walls of the rotary member 49 and the housing 43 due to electrostatic force. Furthermore, the elimination objects can be efficiently sucked by the suction portion 48.

The structure for classifying and separating the defibrated objects into the first classified objects and the second classified objects in the paper producing apparatus 100 is not limited to the classifying portion 40 having the drum 41. For example, the defibrated objects obtained through the defibration processing in the defibration portion 20 may be classified by a classifier. Examples of the classifier include a cyclone classifier, an elbow-jet classifier, and an eddy classifier. These classifiers can classify and separate the defibrated objects into the first classified objects and the second classified objects. Furthermore, these classifiers separate and remove the elimination objects including relatively small or low-density defibrated objects, resin particles, coloring agents, additives, or the like. For example, fine particles contained in the first classified objects may be removed by the classifier. In that case, for example, the second classified objects are returned to the defibration portion 20, the elimination objects are collected by the dust collector 27, and the first classified objects remaining after the removal of the elimination objects are guided to a pipe 54.

The humidifying portion 210 supplies air containing mist to a portion downstream of the classifying portion 40, in the transport path formed by the mesh belt 46. The mist, which contains fine particles of water and is generated by the humidifying portion 210, falls on the first web W1 to moisturize the first web W1. As a result, the moisture content of the first web W1 is adjusted, preventing electrostatic attraction of the fibers to the mesh belt 46.

The paper producing apparatus 100 includes the rotary member 49 that cuts the first web W1 formed on the mesh belt 46 into pieces. The first web W1 is separated from the mesh belt 46 at a position where the mesh belt 46 is guided in another direction by one of the rollers 47, and is cut into pieces by the rotary member 49.

The first web W1 is a soft material in which fibers are deposited in the form of a web. The rotary member 49 disentangles the fibers in the first web W1 so that the fibers are easily mixed with additives in a mixing portion 50 (described below).

Although any desired structure may be employed for the rotary member 49, in this embodiment, the rotary member 49 may have a rotary-vane structure, which has plate-like vanes and rotates. The rotary member 49 is disposed at a position where a vane thereof is in contact with the first web W1 separated from the mesh belt 46. As the rotary member 49 rotates in the direction of arrow R in FIG. 1, for example, the vanes collide with the first web W1 that has been separated from the mesh belt 46 and transported, producing small pieces P.

Desirably, the rotary member 49 is disposed at a position where the vanes thereof do not collide with the mesh belt 46. For example, the distance between the mesh belt 46 and the ends of the vanes of the rotary member 49 may be 0.05 mm to 0.5 mm. This structure allows the rotary member 49 to efficiently cut the first web W1 without damaging the mesh belt 46.

The small pieces P produced by the rotary member 49 move down through the pipe 7 and are transferred (transported) to the mixing portion 50 by the airflow flowing through the pipe 7.

The humidifying portion 206 supplies humidifying air to the space including the rotary member 49 to suppress electrostatic attraction of fibers to the inside of the pipe 7 and the vanes of the rotary member 49. Furthermore, because high-humidity air is supplied to the mixing portion 50 through the pipe 7, the influence of static electricity is suppressed also in the mixing portion 50.

The mixing portion 50 includes an additive supply portion 52 that supplies an additive containing a binding agent, the pipe 54 that communicates with the pipe 7 and through which airflow containing the small pieces P flows, and a mixing blower 56. As described above, the small pieces P are fibers remaining after the removal of the elimination objects from the first classified objects that had passed through the classifying portion 40. The mixing portion 50 mixes the additive containing the binding agent with the fibers constituting the small pieces P.

In the mixing portion 50, the mixing blower 56 generates airflow and transports the small pieces P and the additive through the pipe 54 while mixing them. Furthermore, the small pieces P are disentangled into even smaller fibers while flowing through the pipe 7 and the pipe 54.

The additive supply portion 52 is coupled to an additive cartridge (not shown) that stores the additive therein and supplies the additive to the pipe 54. The additive cartridge may be removably attached to the additive supply portion 52. Furthermore, a structure for supplying the additive to the additive cartridge may be provided. The additive supply portion 52 temporarily stores the additive, which is in the form of fine powder or fine particles, in the additive cartridge. The additive supply portion 52 has a discharge portion 52*a* through which the temporarily stored additive is supplied to the pipe 54.

The discharge portion 52*a* includes a feeder (not shown) that feeds the additive stored in the additive supply portion 52 to the pipe 54, and a shutter (not shown) that opens/closes a pipe coupling the feeder and the pipe 54. By closing the shutter, a pipe or an opening coupling the discharge portion 52*a* and the pipe 54 is closed, and the supply of the additive from the additive supply portion 52 to the pipe 54 is stopped.

When the feeder of the discharge portion 52*a* is not operating, the additive is not supplied from the discharge portion 52*a* to the pipe 54. However, when, for example, the pressure inside the pipe 54 becomes negative, the additive may flow to the pipe 54 even though the feeder of the discharge portion 52*a* is stopped. By closing the discharge portion 52*a*, flow of the additive like this is reliably blocked.

The additive supplied by the additive supply portion 52 contains a binding agent for binding multiple fibers. Examples of the binding agent contained in the additive include thermoplastic resin (AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, etc.), thermosetting resin, starch, dextrin, glycogen, amylose, hyaluronic acid, arrowroot, arum root, dogtooth violet starch, etherified starch, esterified starch, natural gum paste (etherified tamarind gum, etherified locust bean gum, etherified guar gum, acacia arabic gum), fiber inducing paste (etherified carboxymethyl cellulose, hydroxyethyl cellulose), seaweed (sodium alginate, agar), animal protein (collagen, gelatin, hydrolyzed collagen, sericin) or the like. These binding agents may be used alone or in combination, as necessary. More specifically, the additive may be either a single substance or a mixture, or may contain multiple types of particles each composed of a single substance or multiple substances. The additive may be either in the form of fibers or powder.

When heated, the binding agent contained in the additive melts and binds multiple fibers together. Hence, in a state in which the additive and the fibers are mixed together but are not heated to a temperature at which the binding agent melts, the fibers are not bound together.

Besides the binding agent for binding the fibers, the additive to be supplied by the additive supply portion 52 may contain a colorant for coloring the fibers, an aggregation inhibitor for inhibiting aggregation of the fibers or the binding agent, and a flame retardant for preventing or slowing burning of the fibers or the like, according to the type of the sheets to be produced. The additive not containing a colorant may be colorless, a fair color that appears almost colorless, or white.

Due to the airflow generated by the mixing blower 56, the small pieces P moving downward through the pipe 7 and the additive supplied by the additive supply portion 52 are sucked into the pipe 54 and pass through the mixing blower 56. The fibers constituting the small pieces P and the additive are mixed together by the airflow generated by the mixing blower 56 and the effect of rotary portions, such as vanes, of the mixing blower 56. This mixture of the first classified objects and the additive is transferred to the deposition portion 60 through the pipe 54.

The mechanism for mixing the first classified objects and the additive is not specifically limited and may be either a mechanism that performs stirring with vanes rotating at a high speed or a mechanism, such as a V-shaped mixer, that utilizes rotation of a container. This mechanism may be disposed either before or after the mixing blower 56.

The deposition portion 60 allows the defibrated objects defibrated in the defibration portion 20 to be deposited. More specifically, the deposition portion 60 introduces the mixture that has passed through the mixing portion 50 from the introduction port 62, disentangles the tangled defibrated objects, and then allows the defibrated objects to fall down while dispersing the defibrated objects in the air. Furthermore, when the binding agent in the additive supplied by the additive supply portion 52 is in the form of fibers, the deposition portion 60 disentangles the tangled binding agent. By doing so, the deposition portion 60 can allow the mixture to be uniformly deposited on the second web forming portion 70.

The deposition portion 60 includes a drum 61 and a housing 63 accommodating the drum 61. The drum 61 is a cylindrical sieve portion that is rotationally driven by a motor. The drum 61 includes mesh, such as a filter or a screen, and serves as a sieve portion. By using pores in the mesh, the drum 61 allows fibers and particles that are smaller than the pores (openings) in the mesh to pass and fall down through the drum 61. The structure of the drum 61 is the same as that of, for example, the drum 41.

The "sieve portion" of the drum 61 does not need to have a function of classifying a specific object. More specifically, the "sieve portion" used as the drum 61 simply means a component having mesh, and the drum 61 may allow everything in the mixture introduced into the drum 61 to fall down therethrough.

A second web forming portion 70 is disposed below the drum 61. The objects that have passed through the deposition portion 60 are deposited on the second web forming portion 70, forming a second web W2. The second web forming portion 70 includes, for example, a mesh belt 72, rollers 74, and a suction mechanism 76 (suction portion). The deposition portion 60 and the second web forming portion 70 correspond to a web forming portion. Furthermore, the drum 61 corresponds to a sieve portion.

The mesh belt 72 is an endless belt stretched over the multiple rollers 74 and is driven in the direction of arrow V2 by the rotation of the rollers 74. The mesh belt 72 is made of, for example, metal, resin, cloth, or nonwoven fabric. The surface of the mesh belt 72 is formed of mesh with openings of a predetermined size. Of the fibers and particles falling down from the drum 61, fine particles that can pass through the pores in the mesh fall down through the mesh belt 72, and fibers that cannot pass through the pores in the mesh are deposited on the mesh belt 72 and are transported in the direction of arrow V2 by the mesh belt 72. The mesh belt 72 runs at a certain speed during the normal operation for producing sheets S. The definition of "during the normal operation" has been described above.

The running speed of the mesh belt 72 may be regarded as the speed at which the second web W2 is transported, and hence, this speed may be regarded as the transportation speed of the second web W2 with the mesh belt 72.

The size of the pores in the mesh belt 72 is fine and may be set such that most of the fibers and particles falling down from the drum 61 cannot pass.

The suction mechanism 76 is disposed below the mesh belt 72, more specifically, on the other side of the mesh belt 72 from the deposition portion 60. The suction mechanism 76 includes a suction blower 77. The suction blower 77 generates downward airflow in the suction mechanism 76, that is, airflow directed from the deposition portion 60 to the mesh belt 72.

The suction mechanism 76 sucks the mixture dispersed in the air by the deposition portion 60 onto the surface of the mesh belt 72. This facilitates the formation of the second web W2 on the mesh belt 72 and increases the discharging speed from the deposition portion 60.

Furthermore, because the suction mechanism 76 generates downflow in the mixture falling path, the defibrated objects and the additive are prevented from being tangled during falling.

The suction blower 77 may discharge the air sucked from the suction mechanism 76 to the outside of the paper producing apparatus 100 through a collecting filter (not shown). Furthermore, the air sucked by the suction blower 77 may be directed to the dust collector 27 so that elimination objects contained in the air sucked by the suction mechanism 76 are collected.

The humidifying portion 208 supplies humidifying air to the space including the drum 61. This humidifying air moisturizes the inside of the deposition portion 60. Hence, attachment of fibers and particles to the housing 63 due to electrostatic force is reduced, allowing the fibers and the particles to quickly fall down on the mesh belt 72 to form the second web W2 of a desired shape.

The humidifying portion 212 supplies air containing mist to a portion downstream of the deposition portion 60 in the transport path formed by the mesh belt 72. With this configuration, the mist generated by the humidifying portion 212 is supplied to the second web W2, and the moisture content in the second web W2 is adjusted. As a result, the electrostatic attraction of the fibers to the mesh belt 72 is suppressed.

The paper producing apparatus 100 includes a transport portion 79 that transports the second web W2 on the mesh belt 72 to the sheet forming portion 80. The transport portion 79 includes, for example, a mesh belt 79*a*, rollers 79*b*, and a suction mechanism 79*c*.

The suction mechanism 79*c* includes a blower (not shown) that generates upward airflow on the mesh belt 79*a* by suction. Due to this airflow, the second web W2 is separated from the mesh belt 72 and is attached to the mesh belt 79*a*. The mesh belt 79*a* is driven by the revolving rollers 79*b*, transporting the second web W2 to a sheet forming portion 80.

The sheet forming portion 80 forms a sheet S from the deposited object formed in the deposition portion 60. More specifically, the sheet forming portion 80 processes the second web W2 (deposited object) deposited on the mesh belt 72 and transported by the transport portion 79 into a sheet S. The processing performed by the sheet forming portion 80 includes applying pressure and heat to the second web W2. In the sheet forming portion 80, by applying a load to the second web W2, the second web W2 is compressed to a uniform thickness, and bonding between the fibers and between the fibers and the additive contained in the second web W2 are increased. Furthermore, the sheet forming portion 80 applies heat to the fibers in the defibrated objects and the additive contained in the second web W2 to bind the multiple fibers in the mixture together through the additive.

The sheet forming portion 80 includes a pressing portion 82 that applies pressure to the second web W2, and a heating portion 84 that heats the second web W2 pressed by the pressing portion 82.

The pressing portion 82 includes a pair of calender rollers 85 (pressure rollers) and applies pressure to the second web W2 by nipping the second web W2 with a predetermined nip pressure. By pressing the second web W2, the thickness thereof is reduced, and the density thereof is increased. One of the calender rollers 85 is a driving roller driven by a motor (not shown), and the other of the calender rollers 85 is a driven roller. As the calender rollers 85 rotate, the second web W2, increased in density by being pressed, is transported to the heating portion 84.

The heating portion 84 may include, for example, a heating roller (heater roller), a hot press molding machine, a hot plate, a hot air blower, an infrared heater, or a flash fixing device. In this embodiment, the heating portion 84 includes a pair of heating rollers 86. The heating rollers 86 are heated to a preset temperature by heaters disposed inside or outside the heating rollers 86. One of the heating rollers 86 is a driving roller driven by a motor (not shown), and the other of the heating rollers 86 is a driven roller. The heating rollers 86 nip and heat the second web W2 pressed by the calender rollers 85 to form a sheet S. As the heating rollers 86 rotate, the sheet S is transported to the cutting portion 90.

In this embodiment, the second web W2 pressed by the pressing portion 82 and then heated by the heating portion 84 in the sheet forming portion 80, which processes the second web W2 into a sheet S, is called a sheet S. In other words, the second web W2 in which the fibers are bound together by the additive is called a sheet S. The sheet S is transported to the cutting portion 90.

The cutting portion 90 cuts the sheet S formed by the sheet forming portion 80. In this embodiment, the cutting portion 90 includes a first cutting portion 92, which cuts the sheet S in a direction intersecting the sheet transport direction F, and a second cutting portion 94, which cuts the sheet S in a direction parallel to the sheet transport direction F. The second cutting portion 94 cuts, for example, the sheet S that has passed through the first cutting portion 92.

Through the above-described process, cut sheets S of a predetermined size are produced. The cut sheets S are discharged to a discharge portion 96. The discharge portion 96 includes a tray or a stacker on which the sheets S of a predetermined size are stacked.

In the above-described structure, first, the coarse crushing portion 12 coarsely crushes the raw material, and then, a sheet S is formed from the coarsely crushed raw material. However, for example, fibers may be used as the raw material to produce the sheet S.

For example, fibers equivalent to the defibrated objects obtained through the defibration processing in the defibration portion 20 may be fed to the drum 41 as the raw material. Alternatively, fibers equivalent to the first classified objects separated from the defibrated objects may be fed to the pipe 54 as the raw material. In these cases, a sheet S can be produced by supplying fibers obtained by processing wastepaper, pulp, or the like to the paper producing apparatus 100.

Next, the deposition portion 60, the second web forming portion 70, and the like will be described in detail.

Figure 2:
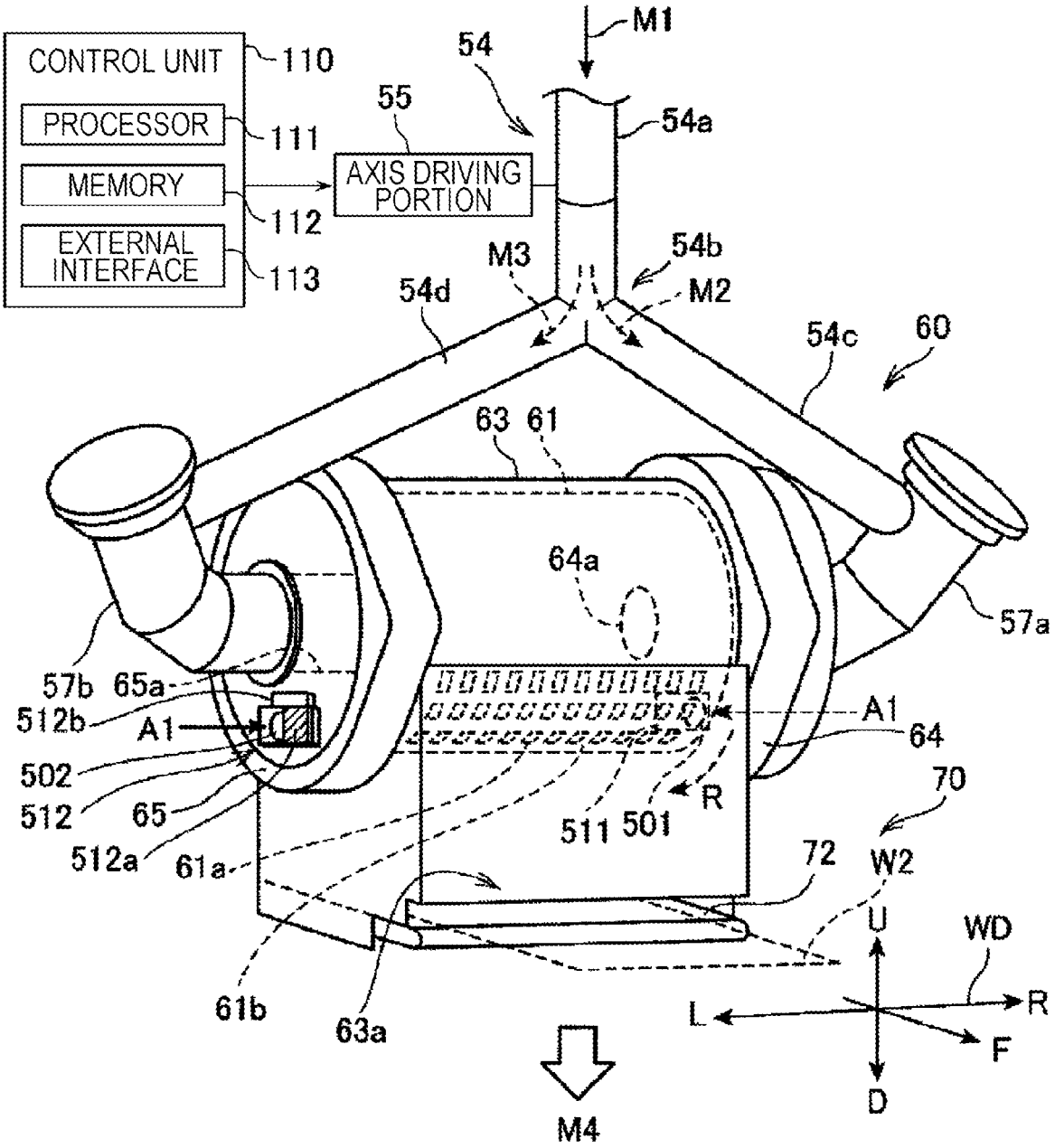
FIG. 2 is a perspective view of a relevant part of the paper producing apparatus.
Figure 3:
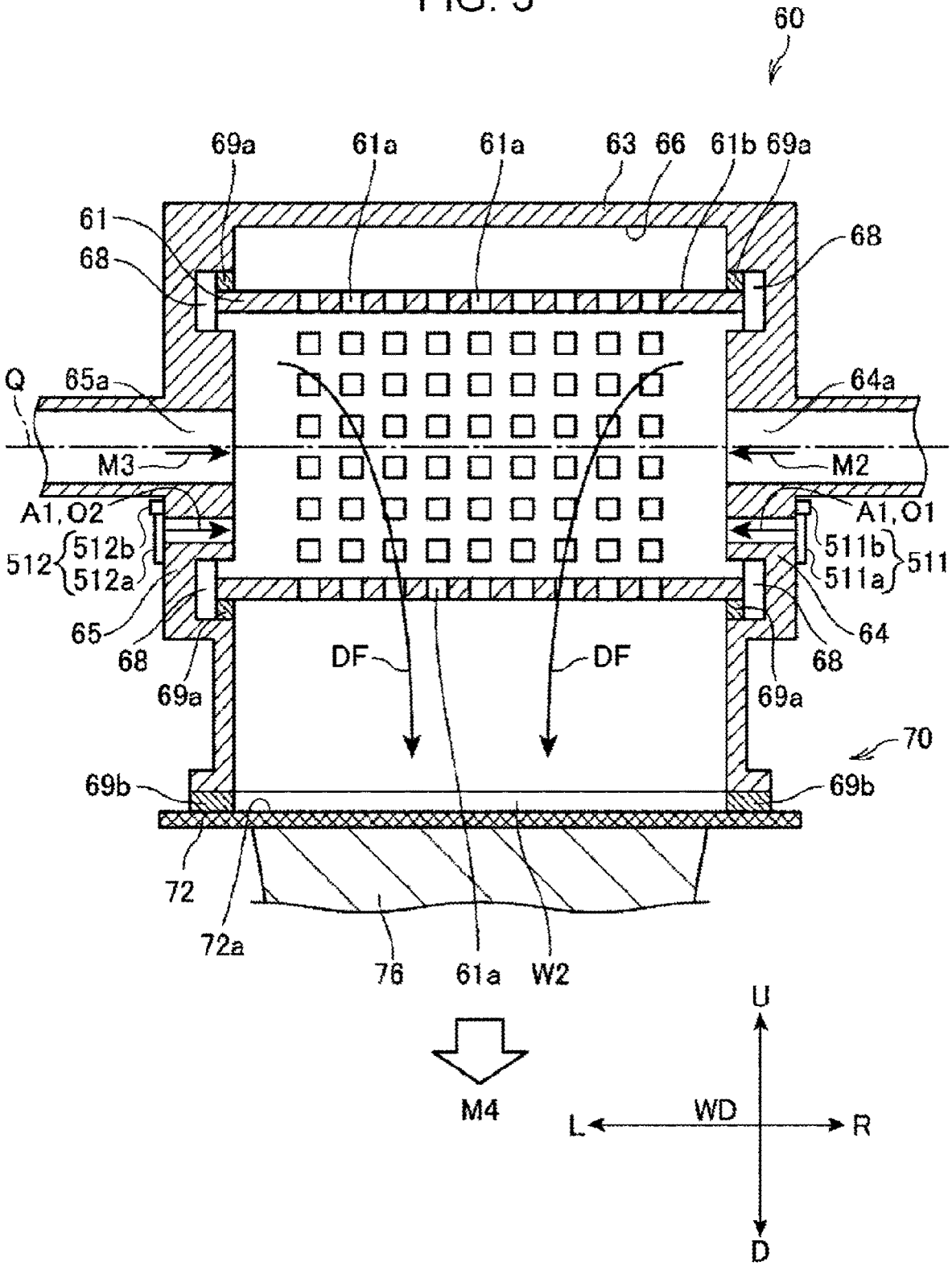
FIG. 3 is a sectional view of the relevant part of the paper producing apparatus.

FIG. 2 is a perspective view of a relevant part of the paper producing apparatus 100, and FIG. 3 is a sectional view of the relevant part of the paper producing apparatus 100. FIGS. 2 and 3 show the detailed structures of the deposition portion 60 and the second web forming portion 70.

As shown in FIGS. 2 and 3, the drum 61 has a hollow cylindrical shape and can rotate about the rotation axis Q. The drum 61 has multiple openings 61*a* in an outer circumferential surface 61*b* thereof, and, as the drum 61 rotates, fibers passing through the openings 61*a* fall down and are deposited on the mesh belt 72, forming a second web W2. Herein, the size, shape, and number of the openings 61*a* provided in the drum 61 are not specifically limited. In order for better understanding, in FIGS. 2 and 3, the openings 61*a* are illustrated in a larger scale relative to the drum 61.

The housing 63 covers at least a portion of the drum 61, the portion having the openings 61*a*, that is, the outer circumferential surface 61*b* having the openings 61*a*, with a space therebetween. In the examples shown in FIGS. 2 and 3, the housing 63 has: an opposing wall portion 66 having an inner surface that faces the outer circumferential surface 61*b*; a right side wall 64; and a left side wall 65 and accommodates the drum 61. The right side wall 64 and the left side wall 65 of the housing 63 are joined to the opposing wall portion 66 and cover the drum 61 in the direction of the rotation axis Q, that is, the direction in which the rotation axis Q extends.

Herein, in FIGS. 2 and 3, the direction of the rotation axis Q corresponds to the left-right direction, and the right direction is indicated by reference sign R, and the left direction is indicated by reference sign L. The sheet transport direction F, the right direction R, and the left direction L are the directions in a plane parallel to the surface of the second web W2. The direction of the rotation axis Q, that is, the R-L direction, is a direction perpendicular to the sheet transport direction F and corresponds to the width direction of the second web W2 and the sheet S. Hence, the R-L direction will be referred to as the width direction WD in the description below.

Furthermore, in FIGS. 2 and 3, a direction perpendicular to the plane including the width direction WD and the sheet transport direction F is the top-bottom direction, and the upward direction is indicated by reference sign U, and the downward direction is indicated by reference sign D.

As shown in FIG. 3, the inner surfaces of the right side wall 64 and the left side wall 65 of the housing 63 have recesses 68. Pile seals 69*a* are provided in the recesses 68. The drum 61 is supported so as to be able to rotate, with a predetermined distance from the housing 63, via the pile seals 69*a*. The pile seals 69*a* are formed of, for example, brushes in which bristles are densely planted in the surfaces of bases.

Air containing the material is supplied to the deposition portion 60 through the pipe 54 (material supply pipe). The pipe 54 has a structure in which a single main pipe 54*a* (first supply pipe) coupled to the mixing blower 56 is split into branch pipes 54*c* and 54*d* (a second supply pipe and a third supply pipe) at a branch portion 54*b*. The branch pipe 54*c* is coupled to an air supply pipe 57*a*, and the branch pipe 54*d* is coupled to an air supply pipe 57*b*.

The mixing blower 56 blows transport airflow M1, which is the air containing the material, through the main pipe 54*a*. The transport airflow M1 is split into transport airflow M2 to flow through the branch pipe 54*c* and transport airflow M3 to flow though the branch pipe 54*d* at the branch portion 54*b*. Herein, as described above, the material contains the fibers (first classified objects) separated in the classifying portion 40 and the additive supplied by the additive supply portion 52, that is, the mixture of the fibers and the additive.

The air supply pipes 57*a* and 57*b*, through which the air containing the material is supplied to the inside of the drum 61, are coupled to the right side wall 64 and the left side wall 65 of the housing 63, respectively. The air supply pipe 57*a* penetrates through the right side wall 64 and communicates with the interior of the drum 61. More specifically, the housing 63 has a material supply port 64*a* communicating with the inner space of the drum 61. Similarly, the air supply pipe 57*b* penetrates through the left side wall 65 and communicate with the interior of the drum 61. The left side wall 65 has a material supply port 65*a* communicating with the inner space of the drum 61.

The transport airflow M2 passes through the branch pipe 54*c* and the air supply pipe 57*a* and enters the interior of the drum 61. The transport airflow M3 flows through the branch pipe 54*d* and the air supply pipe 57*b* and enters the interior of the drum 61. The material contained in the transport airflow M2 and M3 enters the drum 61 in a state of being moisturized by the humidifying air supplied by the humidifying portion 206.

The air supply pipes 57*a* and 57*b* penetrate through the right side wall 64 and the left side wall 65. The airflow containing the material, that is, the transport airflow M2 and M3, enters the interior of the drum 61 through the air supply pipes 57*a* and 57*b* and the material supply ports 64*a* and 65*a*, in the direction of the rotation axis Q. As shown in FIG. 3, the material supply port 64*a* is provided at a position overlapping the rotation axis Q. Similarly, the material supply port 65*a* is provided at a position overlapping the rotation axis Q.

The housing 63 also has intake ports 501 and 502, through which air not containing the material, for example, air outside the housing 63, is supplied to the interior of the drum 61 in the direction of the rotation axis Q of the drum 61. The intake port 501 is a through-hole extending in the direction of the rotation axis Q and penetrates through the right side wall 64. The intake port 502 is a through-hole extending in the direction of the rotation axis Q and penetrates through the left side wall 65. The intake ports 501 and 502 communicate between the space inside the housing 63 and the outside of the housing 63.

It is also possible that the deposition portion 60 is surrounded by a partition wall (not shown), and humidifying air A1 is supplied to the space surrounded by the partition wall, that is, the space where the deposition portion 60 is located, to make the space serve as a humidified space. The humidifying air A1 does not contain the material. The humidifying air A1 is blown by a blower of the humidifying portion 208 or a blower coupled to the humidifying portion 208 and is supplied to the humidified space.

The intake port 501 is provided at a position away from the material supply port 64*a*, and the intake port 502 is provided at a position away from the material supply port 65*a*. As shown in FIGS. 2 and 3, the intake ports 501 and 502 are provided at positions overlapping the interior of the drum 61, when viewed in the direction of the rotation axis Q.

In the structure examples shown in FIGS. 2 and 3, the intake ports 501 and 502 are provided at positions closer to the mesh belt 72 than, for example, the material supply ports 64*a* and 65*a* are. In other words, the distance between the intake ports 501 and 502 and the mesh belt 72 is smaller than the distance between the material supply ports 64*a* and 65*a* and the mesh belt 72.

The mesh belt 72 is disposed below the housing 63. The mesh belt 72 constitutes the bottom surface of the housing 63 and projects to the outside of the housing 63 through an opening 63*a* provided in the lower portion of the housing 63. The material falling down from the drum 61 is deposited on a deposition surface 72*a*, which is the top surface of the mesh belt 72.

As described above, the suction mechanism 76 is disposed below the mesh belt 72 and sucks the air, thus forming downward airflow, through the mesh belt 72. More specifically, the suction blower 77 of the suction mechanism 76 generates suction airflow M4. As a result, downflow DF flowing in the downward direction D is generated in the housing 63.

As described, in the inner space of the housing 63, while the transport airflow M2 and M3 flows into the drum 61, the suction mechanism 76 sucks the air from below. Hence, the downflow DF directed from the interior of the drum 61 toward the mesh belt 72 is generated, allowing the material to fall down on the deposition surface 72*a* through the openings 61*a*.

Furthermore, when the volume of the air sucked by the suction mechanism 76 is larger than the volume of the air entering the drum 61 through the material supply ports 64*a* and 65*a*, outside air 01 and 02 enters the drum 61 through the intake ports 501 and 502 shown in FIG. 2, respectively, due to the difference in the volume of the air. As shown by arrows in FIG. 3, the outside air 01 and 02 flows into the drum 61 and becomes part of the downflow DF. Furthermore, as described above, when the space including the deposition portion 60 is moisturized, the outside air 01 and 02 entering the interior of the drum 61 serve as the humidifying air A1.

When the volume of the air sucked by the suction mechanism 76 is a first air volume, and the volume of the transport airflow M2 and M3 entering the drum 61 is a second air volume, the intake ports 501 and 502 allow the outside air 01 and 02 to pass according to the difference between the first air volume and the second air volume. Hence, by providing the intake ports 501 and 502, the first air volume and the second air volume can be independently adjusted or controlled. As long as the first air volume is larger than the second air volume, the material does not leak out through the intake ports 501 and 502.

Pile seals 69*b* are provided between the housing 63 and the mesh belt 72. The pile seals 69*b* have, for example, a rectangular parallelepiped shape and are formed of brushes in which bristles are densely planted in the surfaces of bases. By providing the pile seals 69*b* between the right side wall 64 and the mesh belt 72 and between the left side wall 65 and the mesh belt 72, leakage of the defibrated objects from the gap between the housing 63 and the mesh belt 72 is prevented.

Furthermore, in the paper producing apparatus 100 according to this embodiment, an intake restricting member 511 is provided at the intake port 501, and an intake restricting member 512 is provided at the intake port 502. Because the intake restricting members 511 and 512 have the same structure, the intake restricting member 512 will be described with reference to FIG. 2. The intake restricting member 512 includes a restricting plate 512*a*, which is provided on the outer surface of the left side wall 65 so as to be able to slide along the left side wall 65, and a plate driver 512*b* for moving the restricting plate 512*a*. The restricting plate 512*a* can slide between a position where it closes the intake port 502 in the left side wall 65 and a position where it does not close the intake port 502. Hence, by moving the restricting plate 512*a*, the opening area of the intake port 502 on the outside of the housing 63 can be changed. The plate driver 512*b* includes an actuator or the like and operates under the control of a control unit 110 to move the restricting plate 512*a*. The control unit 110 can adjust the opening area of the intake port 502 by controlling the plate driver 512*b*.

The intake restricting member 511 provided at the intake port 501 includes a restricting plate 511*a* that slides between a position where it closes the intake port 501 and a position where it opens the intake port 501 so as to change the opening area of the intake port 501, and a plate driver 511*b* that moves the restricting plate 511*a*. Similarly to the plate driver 512*b*, the plate driver 511*b* has an actuator or the like and operates under the control of the control unit 110 to move the restricting plate 511*a*. The control unit 110 can adjust the opening area of the intake port 501 provided in the right side wall 64 by controlling the plate driver 511*b*.

The volume of the outside air entering through the intake ports 501 and 502 is determined by the difference between the first air volume and the second air volume described above. Hence, if the opening area of the intake port 501 provided in the right side wall 64 is reduced by the restricting plate 511*a*, the ventilation resistance against the outside air 01 entering through the intake port 501 increases. As a result, the volume of the outside air 01 entering the drum 61 through the intake port 501 decreases, and the volume of the outside air 02 entering through the intake port 502 increases correspondingly. On the contrary, if the opening area of the intake port 502 provided in the left side wall 65 is reduced by the restricting plate 512*a*, the ventilation resistance against the outside air 02 entering through the intake port 502 increases. As a result, the volume of the outside air 02 entering the drum 61 through the intake port 502 decreases, and the volume of the outside air 01 entering through the intake port 501 increases correspondingly. When the opening areas of the intake ports 501 and 502 are equal, the volume of the outside air 01 and the volume of the outside air 02 are in equilibrium.

The intake restricting members 511 and 512 are provided as necessary and, thus, may be omitted. It is also possible that only the restricting plates 511*a* and 512*a* are provided, and the plate drivers 511*b* and 512*b* are omitted. In that case, a user of the paper producing apparatus 100 may manually operate the restricting plates 511*a* and 512*a* to adjust the opening areas of the intake ports 501 and 502. In that case, the control unit 110 may be omitted.

Figure 4:
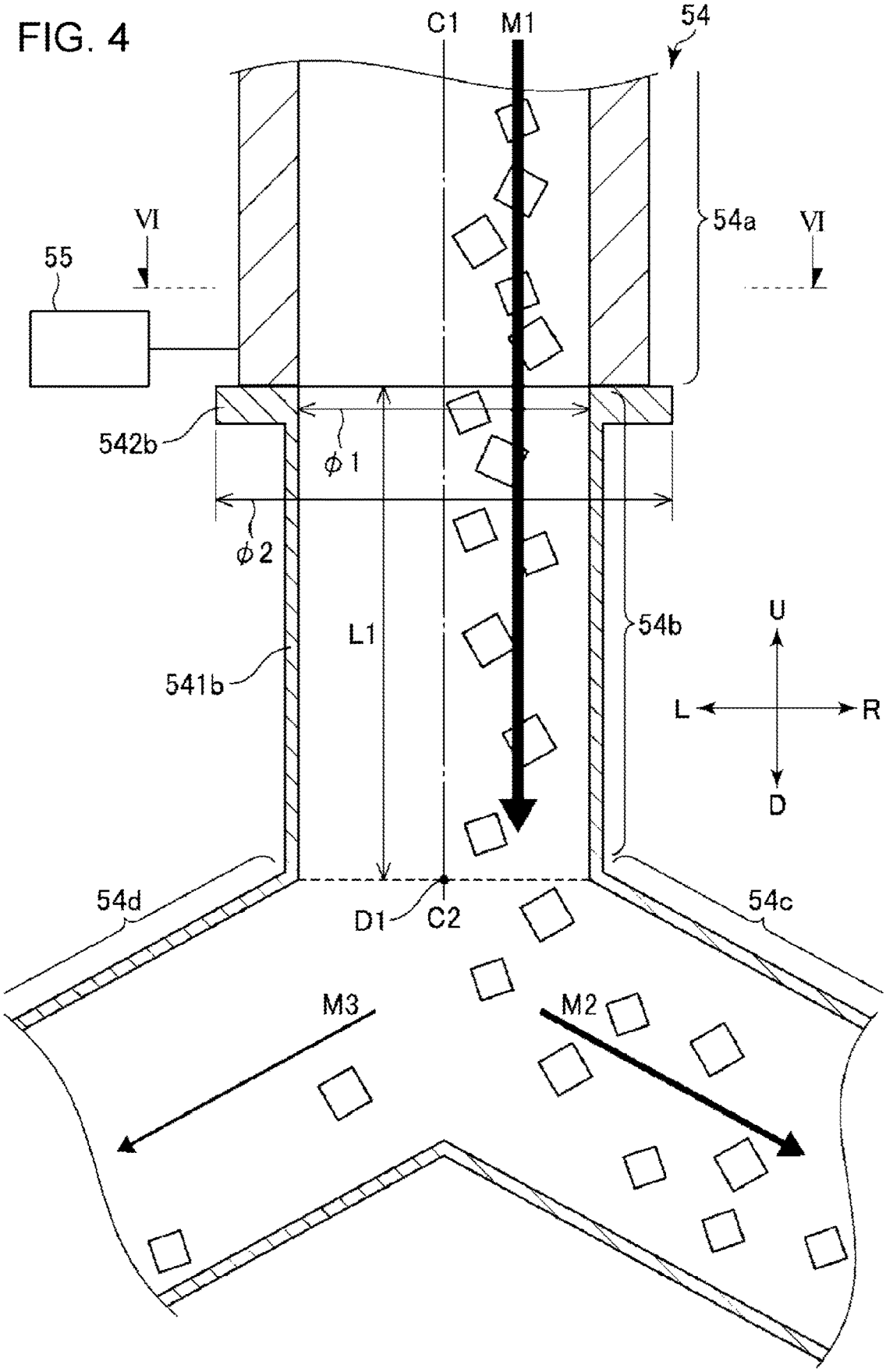
FIG. 4 is an enlarged view of the relevant part of the paper producing apparatus shown in FIG. 2, and more specifically, a sectional view of a material supply pipe and an axis driver.
Figure 5:
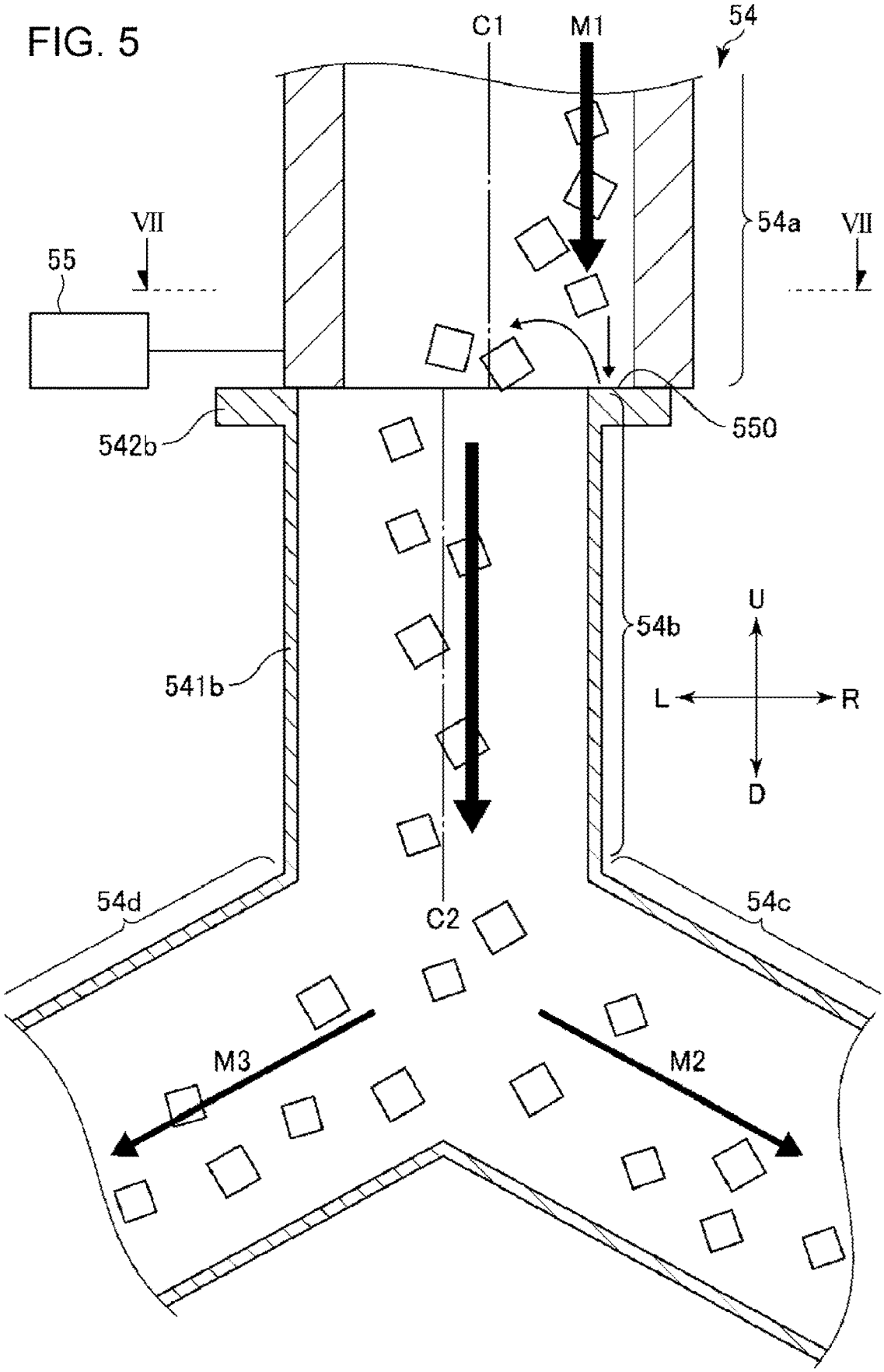
FIG. 5 is an enlarged view of the relevant part of the paper producing apparatus shown in FIG. 2, and more specifically, a sectional view of the material supply pipe and the axis driver.
Figure 6:
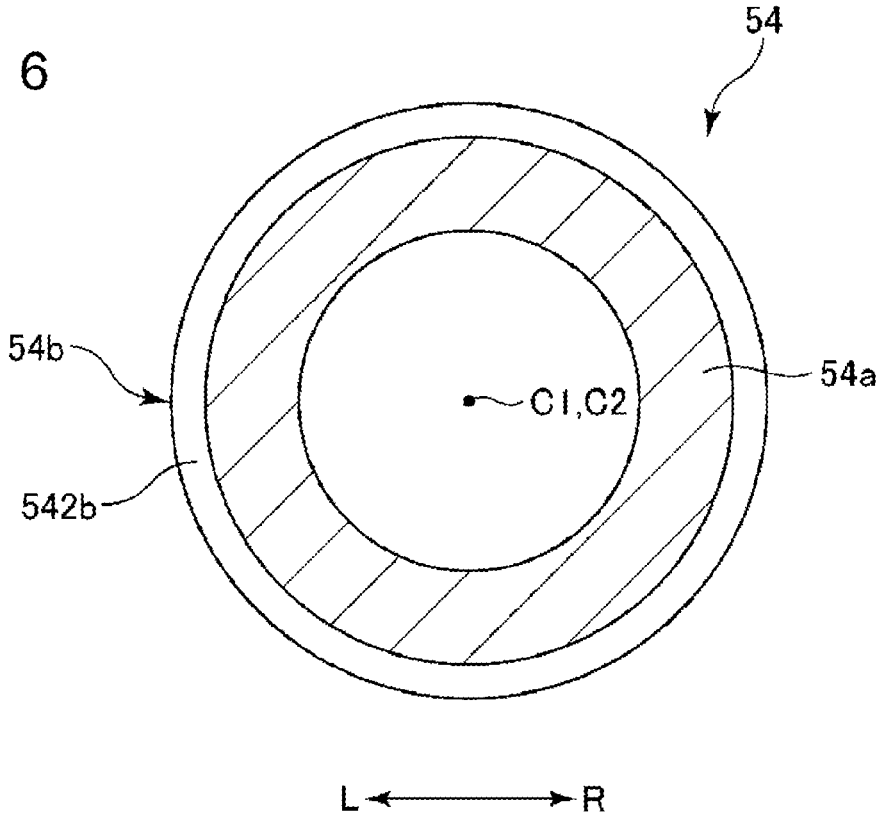
FIG. 6 is a sectional view taken along line VI-VI in FIG. 4.
Figure 7:
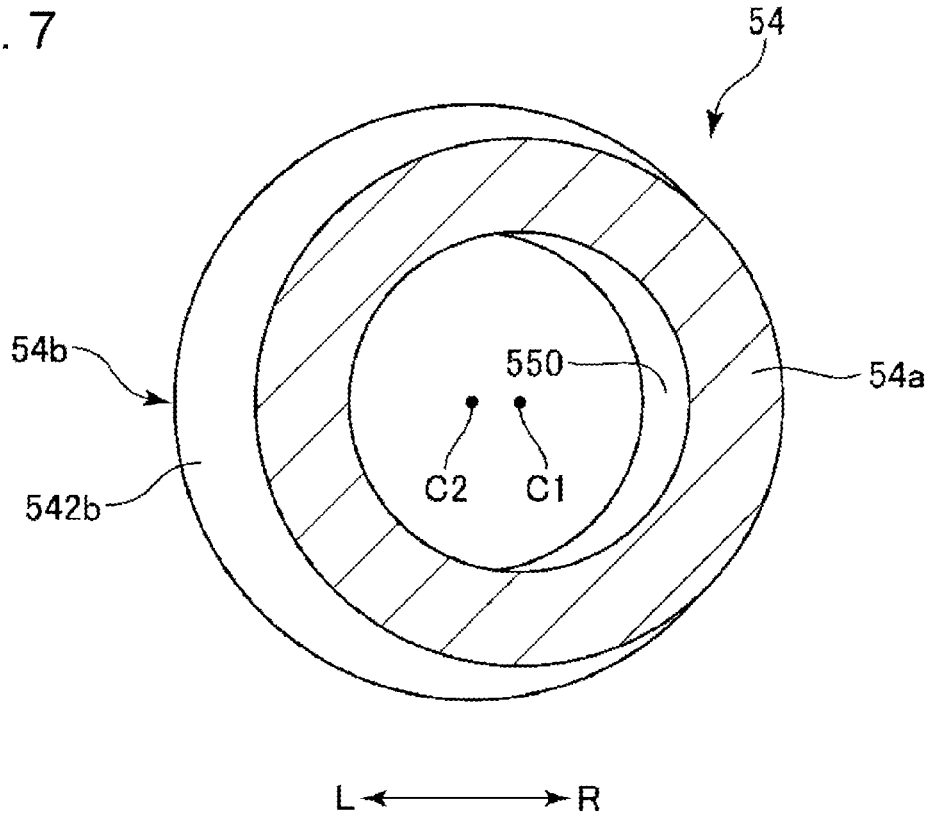
FIG. 7 is a sectional view taken along line VII-VII in FIG. 5.

FIGS. 4 and 5 are enlarged views of the relevant part of the paper producing apparatus 100 as shown in FIG. 2, and more specifically, are sectional views of the pipe 54 and an axis driver 55 (described below). FIG. 6 is a sectional view taken along line VI-VI in FIG. 4, and FIG. 7 is a sectional view taken along line VII-VII in FIG. 5. In FIGS. 4 and 5, the material contained in the transport airflow M1, M2, and M3 is schematically illustrated as squares.

The pipe 54 (material supply pipe) shown in FIGS. 4 and 5 includes the main pipe 54*a* (first supply pipe) coupled to the mixing blower 56 shown in FIG. 1, the branch portion 54*b* where the main pipe 54*a* is split, the branch pipe 54*c* (second supply pipe) and the branch pipe 54*d* (third supply pipe) extending from the branch portion 54*b*, and the axis driver 55.

The axis driver 55 is a driving mechanism that shifts the axis of one of the main pipe 54*a* and the branch portion 54*b* with respect to the axis of the other. In other words, in this embodiment, either one or both of the main pipe 54*a* and the branch portion 54*b* can be displaced in a direction perpendicular to the axis thereof. The axis driver 55 has a mechanism that moves either one or both of the main pipe 54*a* and the branch portion 54*b* and holds them in those positions. By providing this mechanism, the distance between the axis C1 of the main pipe 54*a* and the axis C2 of the branch portion 54*b* in the L-R direction can be controlled. Hence, the flow of the transport airflow M1 from the main pipe 54*a* toward the branch portion 54*b* can be controlled.

To make the main pipe 54*a* and the branch portion 54*b* displaceable, for example, portions of the main pipe 54*a* and the branch portion 54*b* may be formed of bellows-like portions or flexible pipe portions. Instead of making the main pipe 54*a* and the branch portion 54*b* displaceable, the overall structure to which the main pipe 54*a* is coupled or the overall structure to which the branch portion 54*b* is coupled may be configured to be movable.

The axis driver 55 may include, for example, a guide (not shown) that defines a direction in which at least one of the main pipe 54*a* and the branch portion 54*b* is driven, a holding portion (not shown) that holds the at least one of the main pipe 54*a* and the branch portion 54*b* at a desired position on the guide, and a driving source that generates a driving force for moving the main pipe 54*a* or the branch portion 54*b*. By providing this structure, it is possible to precisely move one of the main pipe 54*a* and the branch portion 54*b* relative to the other with high reproducibility. In FIGS. 4 to 7, the axis driver 55 can move one of the main pipe 54*a* and the branch portion 54*b* relative to the other in the L-R direction. Because the axes of the main pipe 54*a* and the branch portion 54*b* can be shifted from each other, the flow of the transport airflow M1 can be easily adjusted in the L-R direction.

Although the main pipe 54*a* and the branch portion 54*b* may be manually moved by a user of the paper producing apparatus 100, in this embodiment, the main pipe 54*a* and the branch portion 54*b* is driven by the axis driver 55. When the main pipe 54*a* and the branch portion 54*b* are manually moved, the above-described driving source and the control unit 110 can be omitted.

The axis driver 55 includes an actuator such as an electric actuator, an electromagnetic actuator, a pneumatic actuator, or a piezo actuator. These actuators have the above-described guide and the holding portion and have a function of moving the main pipe 54*a* or the branch portion 54*b* to an intended position and keep the main pipe 54*a* or the branch portion 54*b* in that position. In other words, these actuators have a function of controlling the amount of movement. Hence, these actuators are useful as the axis driver 55.

The operation of the axis driver 55 is controlled by the control unit 110 shown in FIG. 2. With this configuration, the operation of the axis driver 55 can be controlled according to the parameters such as the flow rate of the transport airflow M1, the amount of the material contained in the transport airflow M1, the amount of moisture in the transport airflow M1, and the thickness or the grammage distribution of the formed second web W2 or sheet S. Hence, the second web W2 can be produced with optimum conditions according to the parameters.

Herein, referring to FIGS. 4 to 7, advantages of the paper producing apparatus 100 according to this embodiment will be described.

FIGS. 4 and 6 show states in which this embodiment is not effective.

In FIG. 4, the transport airflow M1 flows unevenly on the R side with respect to the axis C1 of the main pipe 54*a*. This uneven distribution of the transport airflow M1 can be caused by the structure of an upstream portion of the main pipe 54*a*. For example, when a portion of the main pipe 54*a* not shown in FIG. 4 is bent, the transport airflow M1 flows unevenly on the outer side of the bent portion. The influence of such unevenness is likely to cause uneven distribution of the transport airflow M1 at the position shown in FIG. 4. Furthermore, when a centrifugal fan (not shown) or the like is provided in the main pipe 54*a*, the influence thereof may cause uneven distribution. If the transport airflow M1 flows unevenly on the R side, the material contained therein also flows unevenly on the R side.

In FIG. 6, the axis C1 of the main pipe 54*a* and the axis C2 of the branch portion 54*b* are aligned at the coupling portion of the main pipe 54*a* and the branch portion 54*b*. Hence, there is no step between the inner wall of the main pipe 54*a* and the inner wall of the branch portion 54*b* at the coupling portion. As a result, the transport airflow M1 flowing unevenly on the R side passes through the coupling portion of the main pipe 54*a* and the branch portion 54*b* without changing the direction and flows into the branch portion 54*b*. Hence, when the transport airflow M1 entering the branch portion 54*b* is split into the transport airflow M2 and the transport airflow M3 at the branch portion 54*b*, the transport airflow M2 directed to the R side contains more material than the transport airflow M3 directed to the L side. As a result, more material flows into the drum 61 from the R side than from the L side. When the amount of the material flowing into the drum 61 is unequal between the R side and the L side like this, a second web W2 formed on the mesh belt 72 will have different thicknesses on the left side and on the right side and will be nonuniform.

FIGS. 5 and 7 show states in which this embodiment is effective.

Also in FIG. 5, the transport airflow M1 flows unevenly on the R side in the main pipe 54*a*. However, the axis driver 55 shown in FIG. 5 shifts the axis C1 of the main pipe 54*a* to the R side with respect to the axis C2 of the branch portion 54*b*. As described above, the axis C2 of the branch portion 54*b* may be shifted to the L side with respect to the axis C1 of the main pipe 54*a*; that is, the axis driver 55 only needs to shift the axis C1 of the main pipe 54*a* with respect to the axis C2 of the branch portion 54*b*. Hereinbelow, for ease of explanation, this operation will be simply described as "shifting the main pipe 54*a*".

When the main pipe 54*a* is shifted, a step 550, as shown in FIGS. 5 and 7, appears on the inner wall of the coupling portion of the main pipe 54*a* and the branch portion 54*b*. Because this step 550 appears in the flow path of the transport airflow M1, the step 550 disturbs the flow of the transport airflow M1, and the transport airflow M1 and the material contained therein collide with the step 550 and bounce off toward the axis C1. As a result, the transport airflow M1 flows near the axis C2 of the branch portion 54*b*. Hence, by allowing the transport airflow M1 to collide with the step 550, the unevenness of the transport airflow M1 is reduced.

After the unevenness has been reduced, the transport airflow M1 flows into the branch portion 54*b* and is split into the transport airflow M2 and the transport airflow M3. Hence, the difference between the amount of the material contained in the transport airflow M2 flowing on the R side and the amount of the material contained the transport airflow M3 flowing on the L side is reduced. As a result, the material flows into the drum 61 evenly from the L side and from the R side, and thus a second web W2 having a more uniform thickness is obtained. Shifting the main pipe 54*a* is unlikely to increase the flow resistance of the path through which the transport airflow M1 flows. Hence, with this method, the material can be smoothly circulated even when, for example, the material is aggregated and is difficult to be circulated. Thus, a second web W2 having a uniform thickness can be produced stably.

Although the axis driver 55 according to this embodiment is configured to shift the main pipe 54*a* in the L-R direction, the axis driver 55 may be configured to shift the main pipe 54*a* in a direction perpendicular to both the L-R direction and the U-D direction; that is, in the direction of the thickness of the paper of FIGS. 4 and 5.

Herein, as shown in FIG. 4, the starting point of the branch pipes 54*c* and 54*d* is assumed to be "branch point D1". The branch point D1 is an intersection point between the axis C2 and a plane including a boundary between the inner wall of the branch portion 54*b* and the inner wall of the branch pipe 54*c* and a boundary between the inner wall of the branch portion 54*b* and the inner wall of the branch pipe 54*d*. The distance between the branch point D1 and the coupling portion of the main pipe 54*a* and the branch portion 54*b* is assumed to be L1. The inside diameter of the branch portion 54*b* at the coupling portion is assumed to be φ1.

At this time, the ratio of the distance L1 to the inside diameter φ1, that is, the ratio L1/φ1, is desirably 0.5 to 10.0, more desirably 1.0 to 8.0, and even more desirably 1.5 to 5.0. By setting the ratio L1/φ1 to a value within the above-mentioned ranges, the distance necessary for sufficiently reducing the unevenness of the transport airflow M1 is ensured. Hence, the transport airflow M1 can be brought further toward the axis C2 of the branch portion 54*b*, making it possible to obtain a second web W2 having a more uniform thickness.

When the ratio L1/φ1 is smaller than the lower limit value mentioned above, the distance L1 is too short with respect to the inside diameter φ1. In this case, the unevenness of the transport airflow M1 cannot be sufficiently reduced, depending on the flow rate of the transport airflow M1 or the like. More specifically, the transport airflow M1 may be split before being brought toward the axis C2 sufficiently. Meanwhile, when the ratio L1/φ1 is larger than the upper limit value, the distance L1 is too long with respect to the inside diameter φ1, which gradually increases the possibility of entanglement of the material during transportation or the possibility of stagnation of the flow. As a result, the transport airflow M1 may become unable to be split evenly.

The branch portion 54*b* shown in FIG. 4 includes a body 541*b*, which is located closer to the branch pipes 54*c* and 54*d* and extends in the U-D direction, and a large diameter portion 542*b*, which is located closer to the main pipe 54*a* than the body 541*b* is. The thickness of the pipe wall of the large diameter portion 542*b* is larger than that of the body 541*b*; that is, the large diameter portion 542*b* has an outside diameter φ2 that is larger than the outside diameter of the body 541*b*.

This large diameter portion 542*b* prevents a gap from being formed at the coupling portion when the main pipe 54*a* is shifted in the L-R direction. In other words, by making the large diameter portion 542*b* have a sufficiently large outside diameter φ2, a large end face of the branch portion 54*b* necessary for forming the step 550 is obtained.

The ratio of the outside diameter φ2 of the large diameter portion 542*b* to the inside diameter φ1 of the branch portion 54*b*, that is, the ratio φ2/φ1, is desirably 1.01 to 2.0, and more desirably 1.05 to 1.5. With this configuration, it is possible to prevent a gap from being formed at an intermediate position in the pipe 54 and to form the step 550 that is wide enough for the transport airflow M1 to collide with.

Although the branch portion 54*b* has the large diameter portion 542*b* in this embodiment, the main pipe 54*a* may have the large diameter portion, or both of the branch portion 54*b* and the main pipe 54*a* may have the large diameter portions.

As described above, the control unit 110 shown in FIG. 2 controls the operation of the axis driver 55. The control unit 110 includes a processor 111, a memory 112, an external interface 113, and the like coupled to one another via an internal bus.

An example of the processor 111 is a central processor unit (CPU). Examples of the memory 112 include a read only memory (ROM) and a random access memory (RAM). The external interface 113 includes, for example, a circuit that acquires signals output from sensors or the like.

The processor 111 reads out and executes programs stored in the memory 112 to achieve the functions of the control unit 110. The memory 112 stores various data, and the processor 111 reads out the data. With this system, the control unit 110 can appropriately control the direction in which the main pipe 54*a* is shifted or the amount by which the main pipe 54*a* is shifted based on, for example, the flow rate of the transport airflow M1, the amount of the material contained in the transport airflow M1, the amount of moisture contained in the transport airflow M1, or the like.

Figure 8:
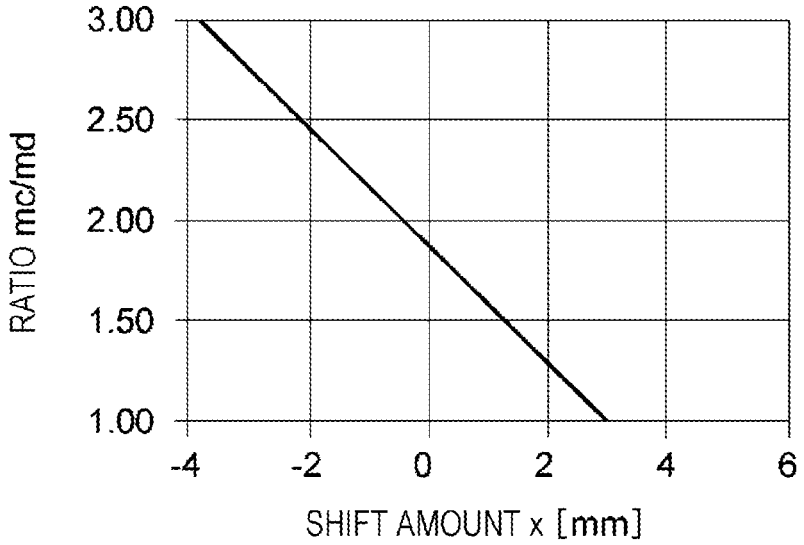
FIG. 8 is a graph showing the relationship between a shift amount x of a first supply pipe and a ratio mc/md, which is the ratio of the amount of the material recovered in a second supply pipe, mc, and the amount of the material recovered in a third supply pipe, md.

FIG. 8 is a graph showing the relationship between the shift amount x of the main pipe 54*a* and the ratio mc/md, which is the ratio of the amount of the material mc collected in the branch pipe 54*c* to the amount of the material and collected in the branch pipe 54*d*. The shift amount x is zero when the axis C1 of the main pipe 54*a* and the axis C2 of the branch portion 54*b* are aligned, as shown in FIG. 4. When, as shown in FIG. 5, the axis C1 is shifted to the R side with respect to the axis C2, the distance between the axis C1 and the axis C2 in the L-R direction corresponds to a positive value of the shift amount x. Although not illustrated, when the axis C1 is shifted to the L side with respect to the axis C2, the distance between the axis C1 and the axis C2 in the L-R direction corresponds to a negative value of the shift amount x.

As shown in FIG. 8, the ratio mc/md has a certain correlation with the shift amount x. Hence, the ratio mc/md can be controlled to a desired value by controlling the shift amount x. As a result, it is possible to control the left-right balance of a second web W2 as desired and thus to produce a second web W2 having a uniform thickness. For example, in the example shown in FIG. 8, when the shift amount x is set to approximately 3 mm, the ratio mc/md is approximately 1.0, and the balance between the left side and the right side of the second web W2 is achieved. By utilizing the correlation shown in FIG. 8, a second web W2 having different thicknesses on the left side and the right side can also be produced.

As has been described above, the paper producing apparatus 100 according to this embodiment includes the drum 61 (sieve portion), the second web forming portion 70 (web forming portion), the sheet forming portion 80, and the pipe 54 (material supply pipe). The drum 61 has the openings 61*a*. The second web forming portion 70 has the deposition surface on which the material passing through the openings 61*a* and containing the fibers is deposited, and a second web W2 is formed on the deposition surface. The sheet forming portion 80 processes the second web W2 into a sheet S. The pipe 54 includes the main pipe 54*a* (first supply pipe), the branch portion 54*b*, the branch pipe 54*c* (second supply pipe), the branch pipe 54*d* (third branch pipe), and the axis driver 55. The branch portion 54*b* splits the main pipe 54*a*. The branch pipe 54*c* couples the branch portion 54*b* and one end of the drum 61 in the rotation axis direction. The branch pipe 54*d* couples the branch portion 54*b* and the other end of the drum 61 in the rotation axis direction. The axis driver 55 drives one of the main pipe 54*a* and the branch portion 54*b* so as to shift the axis thereof with respect to the axis of the other.

This structure shifts, for example, the axis C1 of the main pipe 54*a* with respect to the axis C2 of the branch portion 54*b*, forming the step 550 on the inner wall of the coupling portion of the main pipe 54*a* and the branch portion 54*b*. When the transport airflow M1 collides with the step 550, the material contained in the transport airflow M1 bounces off toward the axis C2. As a result, the unevenness of the transport airflow M1 is reduced. This improves the balance between the amount of the material flowing into the drum 61 from the left side and the amount of the material flowing into the drum 61 from the right side, enabling a second web W2 having an even more uniform thickness to be produced.

The axis driver 55 moves the axis C1 of the main pipe 54*a* (first supply pipe) in the direction perpendicular to the axis C2 of the branch portion 54*b*, that is, in the L-R direction. Thus, the flow of the transport airflow M1 containing the material for the second web W2 can be easily controlled in the L-R direction. Thus, the axis driver 55 can optimize the balance between the left side and the right side of the second web W2.

The axis driver 55 also controls the amount by which the axis C1 of the main pipe 54*a* (first supply pipe) is moved with respect to the axis C2 of the branch portion 54*b*. This amount of movement is the shift amount x, which has, as described above, a certain correlation with the ratio mc/md that influences on the balance between the left side and the right side of the second web W2. Hence, the ratio mc/md can be controlled to a desired value by controlling the shift amount x, and thus, the balance between the left side and the right side of the second web W2 can be efficiently optimized.

Furthermore, the paper producing apparatus 100 according to this embodiment has the control unit 110 (controller) that controls the operation of the axis driver 55. The control unit 110 can control the operation of the axis driver 55 according to a parameter, such as the flow rate of the transport airflow M1. This makes it possible to produce a second web W2 having good stability and robustness.

2. Second Embodiment

Next, the paper producing apparatus 100 according to the second embodiment will be described.

Figure 9:
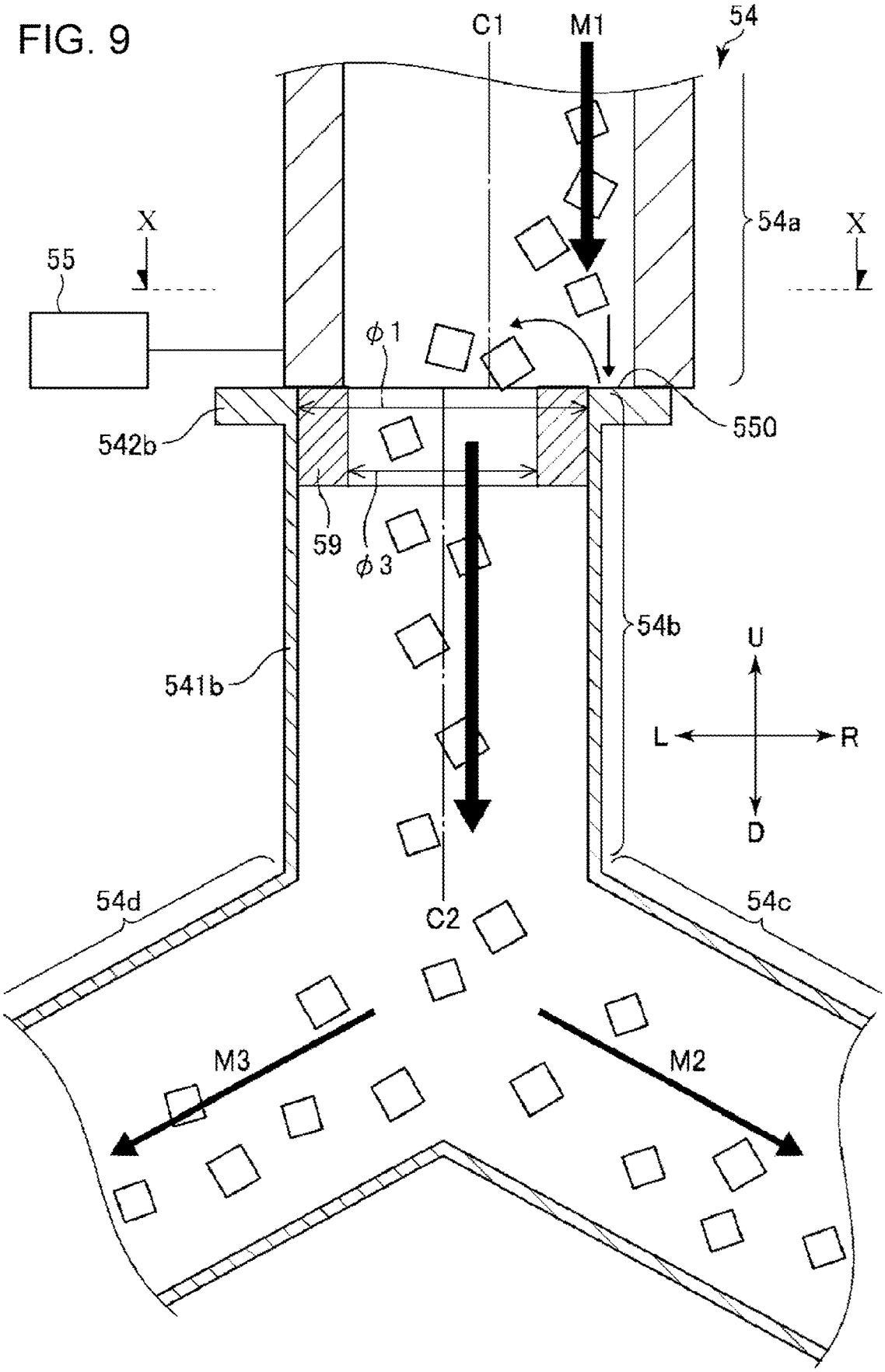
FIG. 9 is an enlarged view of a relevant part of a paper producing apparatus according to a second embodiment.
Figure 10:
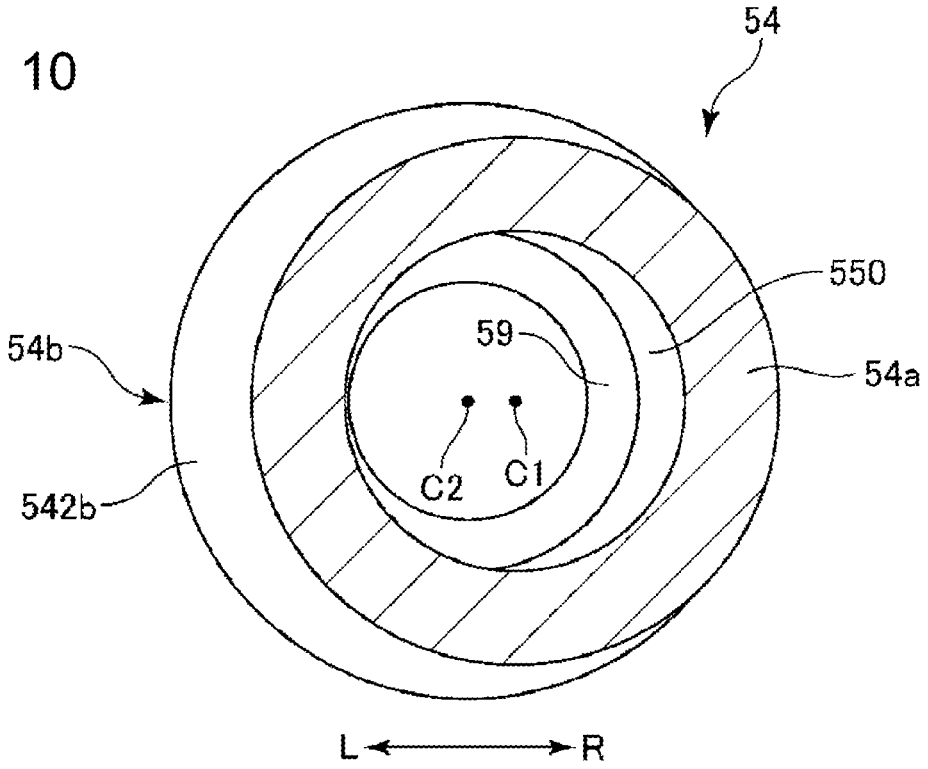
FIG. 10 is a sectional view taken along line X-X in FIG. 9.

FIG. 9 is an enlarged view of the relevant part of the paper producing apparatus 100 according to the second embodiment. FIG. 10 is a sectional view taken along line X-X in FIG. 9.

In the description of the second embodiment below, the difference from the first embodiment will be mainly described, and the description of the structures common to those in the first embodiment will be omitted. In FIGS. 9 and 10, the same structures as those in the first embodiment will be denoted by the same reference signs.

The second embodiment is the same as the first embodiment except that the pipe 54 has an orifice 59. The orifice 59, as shown in FIG. 9, is provided on the inner side of the large diameter portion 542*b* of the branch portion 54*b* and serves as a narrowing member that reduces the inside diameter φ1 of the large diameter portion 542*b*. The orifice 59 expands the step 550 formed when the main pipe 54*a* is shifted. More specifically, the orifice 59 substantially further increases the thickness of the pipe wall of the large diameter portion 542*b* of the branch portion 54*b*. Hence, by providing the orifice 59 at the position of the step 550, the step 550 can be expanded toward the axis C2.

As a result, even when the transport airflow M1 flows unevenly on the R side, the unevenness of the transport airflow M1 can be more reliably reduced by allowing the transport airflow M1 to collide with the step 550 or the orifice 59. Furthermore, the orifice 59 reduces the inside diameter φ1 of the branch portion 54*b*. Hence, the transport airflow M1 flowing at a position away from the axis C1 is guided to the vicinity of the axis C2. With these effects, the transport airflow M1 can be brought further toward the axis C2, and thus, a second web W2 having an even more uniform thickness can be produced.

The ratio of an inside diameter φ3 of the orifice 59 to the inside diameter φ1 of the branch portion 54*b*, that is, the ratio φ3/φ1, is desirably 0.40 to 0.99, more desirably 0.50 to 0.95, and most desirably 0.60 to 0.90. This particularly reduces the unevenness of the transport airflow M1, while avoiding an increase in the flow resistance of the branch portion 54*b*. Because it is possible to suppress stagnation of the material, as well as to achieve a balance between the left side and the right side, a second web W2 having a particularly uniform thickness can be produced.

The position of the orifice 59 is not limited to the position shown in FIG. 9, and the orifice 59 may be provided to the D side of the large diameter portion 542*b*, or to the U side of the large diameter portion 542*b*, that is, at a position in the main pipe 54*a*.

As described above, in the paper producing apparatus 100 according to the second embodiment, the pipe 54 (material supply pipe) has the orifice 59 that reduces the inside diameter of the branch portion 54*b*. The orifice 59 expands the step 550 formed when the main pipe 54*a* is shifted.

The second embodiment provides the same advantages as those obtained with the first embodiment. Furthermore, in this embodiment, because the area of the portion with which the transport airflow M1 collide is larger than that in the first embodiment, the unevenness of the flow of the transport airflow M1 is more reliably reduced. Furthermore, because the orifice 59 reduces the inside diameter of the branch portion 54*b*, the flow of the transport airflow M1 is guided to the vicinity of the axis C2.

3. Third Embodiment

Next, the paper producing apparatus 100 according to the third embodiment will be described.

Figure 11:
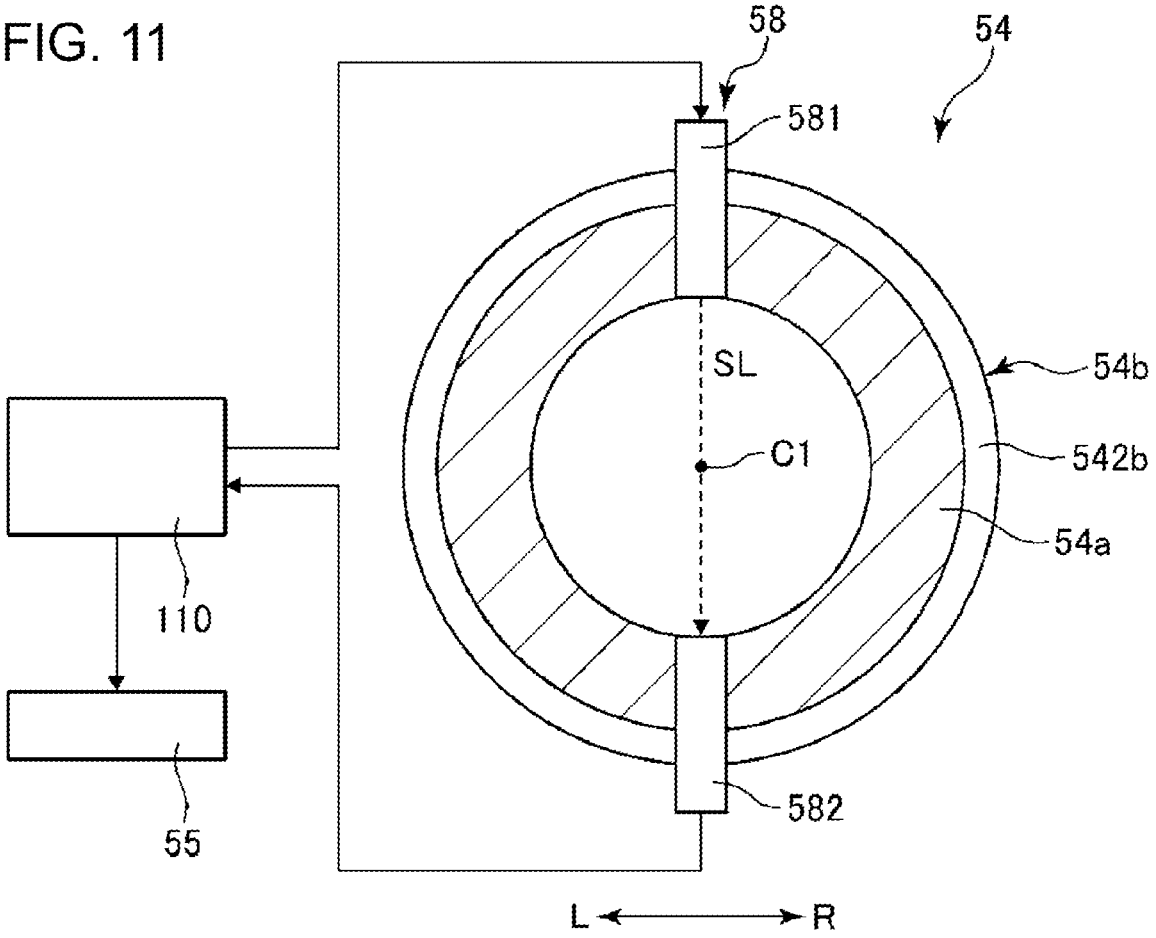
FIG. 11 is an enlarged view of a relevant part of a paper producing apparatus according to a third embodiment.

FIG. 11 is an enlarged view of the relevant part of the paper producing apparatus 100 according to the third embodiment.

In the description of the third embodiment below, the difference from the first embodiment will be mainly described, and the description of the structures common to those in the first embodiment will be omitted. In FIG. 11, the same structures as those in the first embodiment will be denoted by the same reference signs.

The third embodiment is the same as the first embodiment except that an uneven distribution detector 58 is provided. The uneven distribution detector 58 is a sensor that detects unevenness of the material flowing through the main pipe 54*a* (first supply pipe). Examples of the uneven distribution detector 58 include a contact sensor, an image sensor, and an optical sensor.

The contact sensor detects unevenness of the material flowing through the main pipe 54*a* by detecting the contact frequency at which the material makes contact with the inner wall of the main pipe 54*a*. The image sensor detects unevenness of the material by means of image processing, by capturing images of the material flowing through the main pipe 54*a*.

The uneven distribution detector 58 shown in FIG. 11 is an optical sensor. The uneven distribution detector 58 shown in FIG. 11 includes a light emitting portion 581 and a light receiving portion 582. The light emitting portion 581 is, for example, a laser light source, and the light receiving portion 582 is, for example, a photodiode. In the uneven distribution detector 58, detection light SL output from the light emitting portion 581 is received with the light receiving portion 582. The light receiving portion 582 outputs, to the control unit 110, the intensity of the received detection light SL in the form of a received-light signal.

Every time the material crosses the detection light SL, the intensity of the received detection light SL decreases. The control unit 110 detects the frequency of the decrease of the intensity of the received light. In this way, the uneven distribution detector 58 optically detects the amount of the material passed. The control unit 110 shown in FIG. 11 estimates the unevenness of the material passing through the main pipe 54*a* based on the amount of the material passing through the axis C1 of the main pipe 54*a*. The control unit 110 controls the operation of the axis driver 55 based on the thus-estimated unevenness of the material. In this way, the unevenness of the transport airflow M1 is reduced, and thus, the unevenness of the material is reduced.

As described above, the paper producing apparatus 100 according to the third embodiment has the uneven distribution detector 58 that detects unevenness of the material passing through the main pipe 54*a* (first supply pipe). The control unit 110 (controller) controls the operation of the axis driver 55 based on the detection result of the uneven distribution detector 58.

The third embodiment also provides the same advantages as those obtained with the first embodiment. Furthermore, in this embodiment, the control unit 110 detects unevenness of the material and causes the axis driver 55 to reduce the unevenness. Because a user does not need to check the degree of unevenness, but the paper producing apparatus 100 automatically reduces the unevenness, a second web W2 having a uniform thickness can be easily produced.

Although the paper producing apparatus of the present disclosure has been described based on the embodiments illustrated in the drawings, the paper producing apparatus of the present disclosure is not limited to those described in the above-described embodiments. For example, the components in the above-described embodiments may be replaced with components having similar functions and desired structures, or desired structures may be added to the above-described embodiments.

What is claimed is:

1. A paper producing apparatus comprising a sieve portion having a plurality of openings;

a web forming portion having a deposition surface on which a material passing through the openings and containing fibers is deposited, the web forming portion forming a web on the deposition surface;

a sheet forming portion that processes the web into a sheet;

a material supply pipe through which transport airflow containing the material is supplied to an inside of the sieve portion, the material supply pipe including a first supply pipe, a branch portion at which the first supply pipe is split, a second supply pipe that couples the branch portion and one end of the sieve portion in a rotation axis direction, a third supply pipe that couples the branch portion and the other end of the sieve portion in the rotation axis direction, and an axis driver that shifts an axis of one of the first supply pipe and the branch portion with respect to an axis of the other;

a controller that controls an operation of the axis driver; and an uneven distribution detector that detects unevenness of the material passing through the first supply pipe, the controller controlling the operation of the axis driver based on a detection result obtained by the uneven distribution detector.

2. The paper producing apparatus according to claim 1, wherein the material supply pipe includes an orifice that reduces an inside diameter of the branch portion.

3. The paper producing apparatus according to claim 1, wherein the axis driver has a function of moving the axis of the first supply pipe in a direction perpendicular to the axis of the branch portion.

4. The paper producing apparatus according to claim 1, wherein the axis driver has a function of controlling an amount of movement by which the axis of the first supply pipe is moved relative to the axis of the branch portion.

* * * * *